US006065694A

United States Patent [19]

d'Alayer de Costemore d'Arc

[11] Patent Number: 6,065,694

[45] Date of Patent: May 23, 2000

[54] FLOW LIMITER

[75] Inventor: Stephane M. A. d'Alayer de Costemore d'Arc, Genappe, Belgium

[73] Assignee: Staar S.A., Brussels, Belgium

[21] Appl. No.: 09/182,894

[22] Filed: Oct. 30, 1998

Related U.S. Application Data

[63] Continuation-in-part of application No. 09/048,584, Mar. 27, 1998.

[30] Foreign Application Priority Data

Apr. 2, 1997 [BE] Belgium ..... 97 00302
Jun. 11, 1997 [BE] Belgium ..... 97 00504

[51] Int. Cl.[7] ..... B05B 1/30

[52] U.S. Cl. ..... 239/586; 239/574

[58] Field of Search ..... 239/586, 574, 239/70; 138/46; 251/208

[56] References Cited

U.S. PATENT DOCUMENTS

| | | | |
|---|---|---|---|
| 1,484,290 | 2/1924 | Birtch | 239/574 |
| 2,793,075 | 5/1957 | Gulick, Jr. | 239/574 |
| 3,341,168 | 9/1967 | Toeppen | 251/208 |
| 4,214,607 | 7/1980 | Bouteille | 137/499 |
| 4,290,152 | 9/1981 | Kesselman, Sr. | 4/191 |
| 4,606,370 | 8/1986 | Geipel et al. | 137/119 |
| 4,718,128 | 1/1988 | Fan | 4/192 |
| 4,723,567 | 2/1988 | Phlipot et al. | 251/208 |
| 4,804,164 | 2/1989 | Nakazawa et al. | 138/46 |
| 4,838,485 | 6/1989 | Rinkewich | 239/70 |
| 5,054,521 | 10/1991 | Hendrick | 251/208 |
| 5,092,560 | 3/1992 | Chen | 251/129.11 |
| 5,249,773 | 10/1993 | Feld | 251/129.11 |
| 5,360,172 | 11/1994 | Wang | 239/586 |
| 5,361,804 | 11/1994 | Keller et al. | 137/801 |
| 5,501,400 | 3/1996 | Kuo | 239/574 |
| 5,653,260 | 8/1997 | Huber | 137/625.33 |
| 5,730,819 | 3/1998 | Retti | 156/71 |
| 5,884,667 | 3/1999 | North | 138/46 |

FOREIGN PATENT DOCUMENTS

| | | |
|---|---|---|
| 1186758 | 9/1959 | France . |
| 1263430 | 3/1968 | Germany . |
| 4310738 | 10/1994 | Germany . |

*Primary Examiner*—Patrick Brinson
*Assistant Examiner*—Davis Hwu
*Attorney, Agent, or Firm*—Leydig, Voit & Mayer

[57] ABSTRACT

A flow limiter device for liquid delivery systems including a pipe having a liquid inlet and a liquid outlet, two adjacent chambers within the pipe through which liquid flows between the inlet and outlet, one chamber being smaller than the other chamber, a valve member movably mounted in the pipe for movement between a flow-limiting position and a full-flow position, and an internal control element which, when actuated from outside the device, causes the valve member to shift from the flow-limiting to the full-flow position. At the flow-limiting position, the valve member limits flow through the smaller chamber to a predetermined limited-flow rate; pressure exerted on the valve member due to liquid flow through the device is effective to move the valve member to the full-flow position when liquid is admitted through the inlet and the control element is actuated; an abutment carried by the control element has a first position where it determines the location of the valve member relative to the smaller chamber and sets flow-rate at the flow-limiting position, and a second position to which it is moved when the control element is actuated and where, when moved by liquid pressure, the valve member operatively clears the abutment and moves to the full-flow position. Flow is sequential through the chambers in both the flow-limiting and full-flow positions of the valve member. Alternative constructions are shown for operating the internal control element from outside the device including a manual handle, a power actuator, and alternative outside-inside connections including a mechanical through-wall coupling and a magnetic coupling.

43 Claims, 4 Drawing Sheets

FLOW LIMITER

This is a continuation-in-part application of U.S. patent application Ser. No. 09/048,584, filed Mar. 27, 1998.

FIELD OF THE INVENTION

The present invention relates to devices for limiting the flow of liquid in liquid delivery systems and, more particularly, to devices added to liquid taps, faucets and like fixtures for limiting liquid flow in regular use while allowing, upon actuation, a larger flow even full-flow at a maximum flow-rate.

BACKGROUND

In the field of water conservation, both municipally imposed cost increases and water restrictions cause the user to be more careful about water use. Nevertheless, the results of such steps aimed at conservation remain quite unimpressive because, generally, users do not pay a lot of attention to conserving water use, any modification of habits being rather slow to take effect, or users are not directly concerned by the costs. Furthermore, it should be noted that, in regular use, people generally consume more water than what is really needed for most tasks.

To encourage or induce such water conservation, two solutions have already been proposed:

- a stop-valve or a narrowing inside of the liquid pipes but such limit is a permanent one and thus it is impossible to obtain a larger flow when needed;
- for a single handle faucet, removable stop means such as described in the commonly assigned U.S. Pat. No. 5,082,023 but, because such means must be incorporated in the faucets during the manufacturing process, its application is restricted to new faucets only and thus it cannot be retro-fitted or added to already installed faucets, while no solution is brought to all other types of faucets.

SUMMARY OF THE INVENTION

The principal aim and object of the present invention is to overcome the above-described drawbacks, by providing flow limiter devices which, while primarily intended for use in water delivery systems, have application in liquid distribution systems generally, and allow the user to easily adjust flow rate and thereby obtain, when necessary, a larger flow and even the maximum flow. Another major aim and object is to provide such devices which can be easily (1) added by a user to existing faucets, to system taps or installed in-line in liquid delivery systems without requiring any technical or specific assistance or (2) incorporated by a manufacturer in its range of fixtures such as faucets, taps, valves or other liquid supply units.

A further aim and object of the invention is to provide flow limiter devices requiring no detailed instruction or teaching as to the regular movements or actuations required for operation in liquid delivery systems.

Another aim of the invention is to provide simple, low-cost flow limiter devices to reach low manufacturing costs and thus large sales.

In accordance with the invention, several embodiments are shown in which a control element which is external and manually or power actuated, is connected transversely through the outer wall of the flow limiter device to operate a flow-limiting valve inside the device which is shifted, upon actuation of the control element, from a flow-limiting position to a full-flow position. In the through-wall embodiments O-ring sealing members are provided to ensure liquid tightness around the entry of the control element.

Although these through-wall constructions are rather simple and thus of low cost, it has been observed that, when the liquid has impurities or a level of limestone above the average, particles or sediment can adhere to and, in some cases, interfere with and then damage the O-rings after extended use and numerous actuations of the control element, resulting in a liquid leakage and an increase of the torque required for actuating the control element.

A further object of the invention is to overcome such drawbacks by providing flow limiter devices having no mechanical coupling through the wall of the device between an external actuator and the flow-limiting valve.

A related object is to provide a magnetic-coupling between the external actuator and the flow-limiting valve, the housing of the device being then made preferably of plastic.

Accordingly, in a further embodiment, a magnetic coupling is provided between an external actuator or control element and a valve member inside the device. Although this construction is presently more expensive than the mechanical coupling through-wall embodiments of the invention, it is believed that the advantage of a secure liquid tightness combined with a decreasing cost for small magnets will prove commercially or practically important in the near future. Accordingly, a magnetic-coupling embodiment of the invention is disclosed having the above-mentioned advantage and further, because there is no mechanical linkage, the coupling parts cannot wear, another substantial advantage.

Other advantages and characteristics of the present invention will appear from the following description of most preferred embodiments to which modifications can be brought without departing from the scope of the invention and for which:

DETAILED DESCRIPTION OF PREFERRED EMBODIMENTS

First Embodiment (FIGS. 1 to 5)

Figure 1:
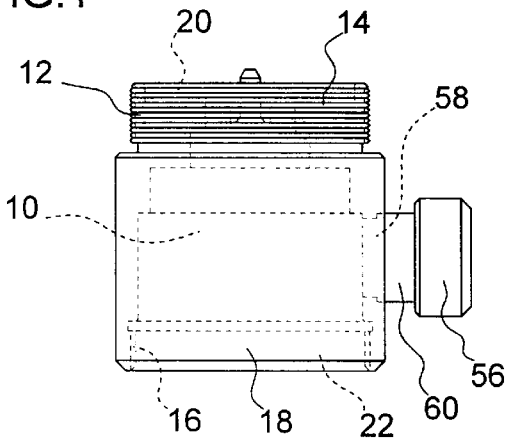
FIG. 1 is a front view of a flow limiter device according to the invention.
Figure 2:
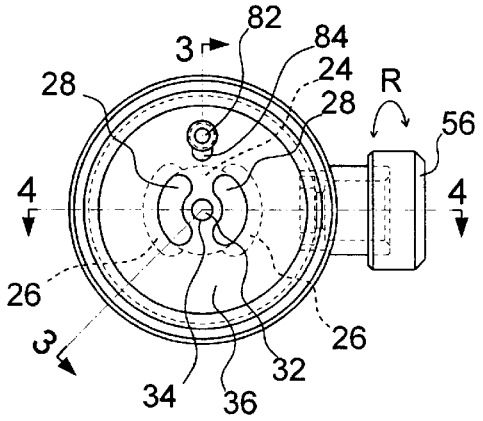
FIG. 2 is a partial top view of a first embodiment of the flow limiter device shown in FIG. 1.

Referring to FIG. 1, this is an exterior plan view of a flow limiter device illustrating that it comprises a cylindrical pipe 10 having an exterior thread 12 on its upper part 14 which is threaded to screw into the standard internal thread of the nozzle of a faucet or tap, or like delivery system fixture, and thereby attach the flow limiter device to the fixture. It also has an internal thread 16 on the lower part 18 to receive a diffuser for a homogeneous discharge liquid stream. The device shown in FIGS. 1 to 5 is an independent flow limiter device designed for attachment to any liquid delivery fixture which has a standard threaded nozzle or for installation in-line in a liquid delivery pipe. The upper part 14 of the pipe 10 has a liquid inlet 20 and the lower part 18 has a liquid outlet 22. When referring to "liquid" in this description, because the flow-limiter device of this invention has uses in delivery or distribution systems for different kinds of liquid, it should be recognized that the principal use envisioned for the device is in water distribution systems as an attachment to a common faucet or tap in the home or in commercial, industrial or agricultural systems for water distribution through lines or to fixtures at work or field locations.

According to the invention, to provide for limiting the flow through the device, the pipe 10 is provided with two co-axially arranged with the pipe central axis and longitudinally adjacent generally cylindrical chambers 24, 26 having different diameters (FIGS. 2, 5); the first chamber 24 which has the smaller diameter is connected to receive liquid from the inlet 20 through two apertures 28, and the second larger chamber 26 which is downstream of the chamber 24 receives liquid from the first chamber 24 and leads the liquid which flows sequentially through the chambers to the liquid outlet 22 in the lower part 18 of the pipe 10 from which it is discharged, said outlet 22 being of the same diameter as the liquid output nozzle of any standard faucet, tap or liquid dispensing unit. To provide for limiting the flow through the pipe 10, a member is slideably mounted for axial movement within the pipe 10, herein shown as a substantially cylindrical valve member 30 that has a diameter which fits within the diameter of the smaller chamber 24, and that is fixed to an upper stem or shaft 32 which is slideably received and guided for vertical movement by an opening 34 provided in a cross-piece 36 shown integral with the pipe 10, the opening 34 being located in-between the apertures 28.

Figure 3:
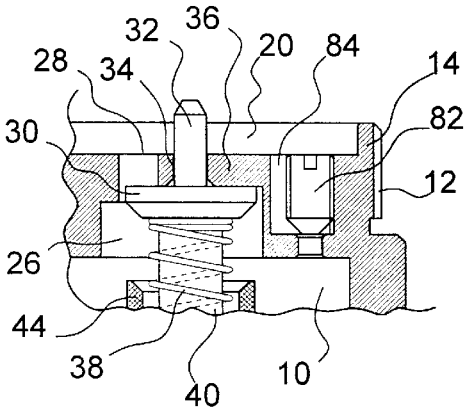
FIG. 3 is a partial sectional view, of the device of FIG. 2 along the plane 3—3.
Figure 4:
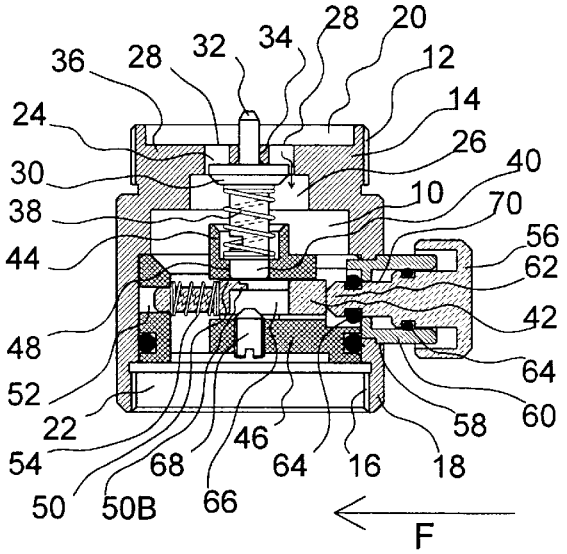
FIG. 4 is a sectional view of FIG. 2 along the plane 4—4.

In keeping with the invention, the valve member 30 has an initial flow-limiting position in which the valve member is located within the first chamber with the liquid turned off ( or with very low pressure liquid admitted through the inlet) as shown in FIGS. 3–4 and, in this position, limits flow through the first smaller chamber 24 into the second larger chamber 26. The valve member 30 undergoes the action of restoring means, such as a compression restore spring 38 concentric with the lower valve stem 40, which pushes the valve member 30 upwardly against the underside of the cross-piece 36.

Figure 5:
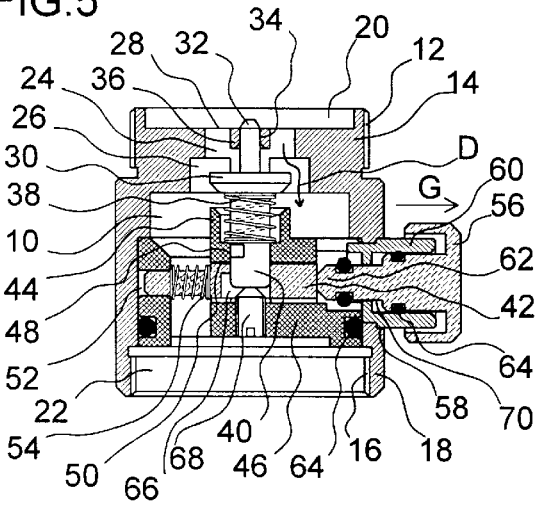
FIG. 5 is similar to FIG. 4, the flow limiter device set in a full-flow condition.

In carrying out the invention, when the fixture is turned on and liquid is admitted into the pipe 10 through the inlet 20, the valve member 30 is acted on by force due to liquid pressure tending to move it toward a full-flow position within the second chamber 26, and the valve member 30 is held in the uppermost flow-limiting position shown in FIGS. 3–4 by a control element 42 which extends transversely through the wall of the pipe 10 into operative engagement with the bottom end of the lower valve stem 40. The uppermost position of the valve member 30 constitutes a flow-limiting position in which it limits flow past the valve member 30 while allowing flow at a predetermined limited-flow rate through the first chamber 24 into the second chamber 26. Further, upon movement of the control element 42 to the full-flow position (FIG. 5) by actuation from outside the pipe 10, the valve member 30 is caused to be moved by the liquid pressure force which overcomes the force of the compression spring 38, thereby shifting the valve member 30 from the flow-limiting position to a full-flow position displaced downwardly from the flow-limiting position, where the flow is relatively unrestricted through the first chamber 24 into the second chamber 26 and through the outlet 22 as shown in FIG. 5.

In summary, the valve member 30 in its flow-limiting position in cooperation with the chamber 24, limits liquid flow, when the faucet, tap, mixing valve, or the like is turned on allowing liquid to enter the liquid inlet 20; the diameter of the valve member 30, in this embodiment, fits within the diameter of the smaller chamber 24 providing a small clearance at the periphery of the valve member 30 which allows flow through the clearance space at the limited-low rate, when the valve member is in the flow-limiting position, which rate is determined by the size of the annular clearance space between the outside of the valve member 30 and the wall of the smaller chamber 24. Force is exerted on the valve member 30 due to liquid pressure urging it downwardly against the force of the compression spring 38 to a full-flow position determined by the control element 42 when actuated. The valve member 30 has a diameter which is substantially less than that of the larger chamber 26 to allow flow through the smaller chamber 24 and past the valve member 30 at a greater full-flow rate due to the clearance between its outer edge and the cylindrical wall of the larger chamber 26, as can be seen in FIG. 5. The valve member 30 is subjected to force exerted by liquid pressure which is opposed by force exerted by the spring 38, the lower end of the spring 38 being guided by and seated at the bottom of an upstanding shoulder 44 provided on a cylindrical guiding element 46 fixed within the pipe 10. The upstanding shoulder 44 is concentric with a hole 48 in the guiding element 46 which is axially aligned with the opening 34 (FIG. 4) in the cross-piece 36 to receive the extremity of the lower stem 40 of the valve member 30 and guide it to slide axially.

To hold the valve member 30 in its raised flow-limiting position within the smaller chamber 24 and cooperating therewith, shown in FIGS. 3–4, against the pressure of liquid entering the pipe 10 when the faucet is turned on, the lower end of the valve stem 40 abuts the upper surface 50 of an end portion of the control element 42 which extends transversely across the pipe 10 through the fixed cylindrical guiding element 46, the forward end of the control element (the left-hand end in FIG. 4) being received in a guide hole 52 in the fixed guiding element 46. A compression spring 54 or other resilient return means opposes forward movement of the control element 42 and keeps the upper surface 50 of the control element 42 under the valve stem 40 in the flow-limiting position of the device. In the present embodiment, the control element 42 is part of a multi-member control assembly and is shown separate from an actuating control button 56. The central section of the pipe 10 is provided with a lateral aperture 58 receiving a tube 60 in which slides a shank portion 62 of the control button 56, the shank 62 bearing against the rear face of the control element 42. A set of O-ring sealing members 64 ensures the liquid-tightness of the tube 60.

In normal use, that is, when the components of the flow limiter device are in their liquid-flow-limiting positions, all the elements described here-above are in the stable position shown in FIGS. 1 to 4; the control element 42 under the action of the return spring 54 keeps the upper surface 50 of its forward end under the valve stem 40 and thus the valve member 30 located in cooperative relation with in the smaller chamber 24. Accordingly, where the pipe 10 is connected to a fixture such as a faucet or liquid tap, when the fixture is turned on liquid flows through the inlet 20, then the apertures 28 , and sequentially through the smaller chamber 24 (past the valve member 30) and the larger chamber 26, then the outlet 22. This sequential or series flow characterizes this embodiment and the flow volume which is obtained, whatever the operating position of the liquid faucet, tap, valve, control/handle, is limited by the annular space between the external periphery of the valve member 30 and the internal periphery or wall of the chamber 24, which in a prototype was a space of about 0.2 mm., that is, about ⅓ of the maximum liquid flow-rate or volume.

When the user wishes to obtain a liquid flow-rate exceeding this limit, the user simply pushes the control button 56 towards the pipe 10 (FIG. 4, arrow F). The control element 42 which is mobile, that is, is longitudinally slideable along an axis perpendicular to the vertical axis of movement of the valve member 30 within the pipe 10, is manually actuated by the control button 56 to move the upper surface 50 from beneath the lower valve stem 40. This frees the valve member 30 which, under the pressure of the liquid, moves downward against the spring 38 (FIG. 5), and enters a recess 66 which extends longitudinally of the pipe-axis in the control element 42 next to the forward end portion which presents the upper surface 50 normally holding the valve member 30 in its raised position. When the lower end of the lower stem 40 of the valve member 30 drops into the recess 66 in the control element 42, the valve member 30 is caused to shift to the full-flow position within the larger chamber 26 and is held in this position by force due to liquid pressure. The valve member 30 allows flow at the full-flow rate past the valve member through a path (D) in the larger chamber 26, even the maximum flow-rate when the fixture is turned fully "ON". In this position (FIG. 5), as the lower stem 40 is engaged in the recess 66, the control element 42 is locked against action of the return spring 54.

To adjust the maximum downward movement allowed for the valve member 30, and thus the maximum liquid flow-rate or volume in the full-flow position of the device, an adjusting screw 68 is provided in the center of the cylindrical guiding element 46 against which the bottom end of the valve stem 40 comes to rest. The flow limiter device then stays in this state until the user reduces or switches off the liquid flow by actuating the control handle, or knob of the liquid faucet, tap or valve, because then the liquid pressure on the valve member 30 is reduced and when it is below the force of the compression spring 38, the latter moves the valve member 30 upward and back into the smaller chamber 24 and accordingly restores the valve member 30 to the flow-limiting position where it limits the liquid flow-rate.

The mobile control element 42 having been released or unlocked as the lower valve stem 40 rises clear of the recess 66, the compression spring 54 returns or pushes back the mobile control element 42 and the control button 56 toward the outside (FIG. 5, arrow G) of the pipe 10, and the upper surface 50 of the control element 42 is again set under the lower stem 40 to keep the valve member 30 in its upper position (FIGS. 3, 4). Thus the flow limiter device is automatically returned to its initial position herein shown as the stable flow-limiting position in which it limits the liquid flow-rate and stays in said position until a new actuation of the control button 56. While not shown in the drawings, the button 56 is preferably made of two concentric parts, the external part having the thread 70 to allow adjustment of the abutment (50), and the internal part allowing actuation of the control element 42.

In a further aspect of the construction of the first embodiment of flow limiter device, the mobile control element 42 is provided at its forward end with two axially arranged horizontal upper surfaces 50, 50B (FIG. 4) set at slightly different levels. The external periphery of the shank 62 of the control button 56 advantageously incorporates a thread 70 meshing with a mating groove within the tube 60 to provide longitudinal adjustment means while the control element 42 is made of a longitudinally movable part. Thus, in accordance with the direction in which the user rotates the control button 56 (FIG. 2, arrow R), its shank 62 is slightly translated to position either one of the surfaces 50, 50B under the lower stem 40 of the valve member 30, the latter surface 50B allowing the valve member 30 to move slightly more downward, thus setting a slightly increased flow-rate.

Accordingly, the user can easily and at any time adjust the limited-flow rate provided by the device without having to remove the device from the faucet or tap on which it is connected. Appropriate operation instructions or indications can be set on the control button 56.

Figure 6:
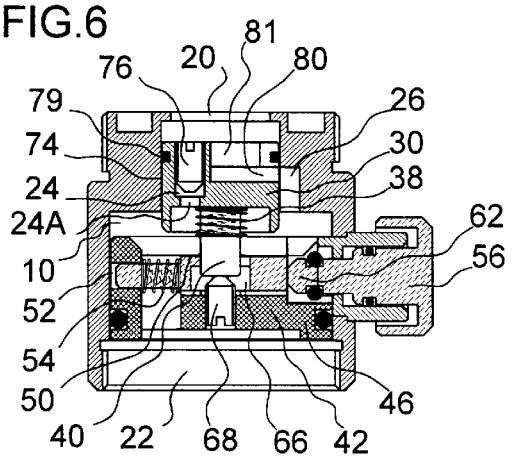
FIG. 6 is similar to FIG. 5 and shows a second embodiment.

Second Embodiment (FIG. 6)

In keeping with the invention, in this embodiment, two adjacent chambers 24 and 26, having almost the same physical flow-rate characteristics as those of the first embodiment, are arranged longitudinally and laterally offset with respect to each other instead of being co-axial as in the first embodiment. Here, the valve member 30 slides like a piston in a cylindrical bore 74 in the pipe 10 which is coaxial with the pipe central axis and constitutes the smaller chamber 24 and which also desirably includes a longitudinal passage 24A in the valve member 30. The passage 24A is provided with a needle valve 76 which adjusts flow past the lower end of the needle valve 76 through a discharge opening in the lower end of the valve member 30. The needle valve 76 is provided for adjustment of the liquid flow-rate through the passage 24A and thus through the smaller chamber 24 when the valve member 30 is in its upper-most position (not shown) within the chamber 24 which is its flow-limiting position. It is urged to its flow-limiting position by the restore spring 38 which positions the valve member 30 with its upper surface adjacent the under edge of the lip of the inlet 20. The valve member 30 is located with a close fit and is sealed by a sealing ring 79 in the bore 74 in the pipe 10 which constitutes the smaller chamber 24. When in the upper-most position in the bore 74, the valve member 30 is located where the wall of the bore 74 blocks flow through a transverse port 80 which is connected to a second longitudinal passage 81 in the valve member 30. This transverse port 80 is unblocked and provides communication from the passage 81 to the larger chamber 26, and thereby allows flow through the passage 81 past the valve member 30 when it is located in its lower position, which is shown in FIG. 6. In this lower position of the valve member 30 the central section of the valve member 30 which has the transverse port 80 is located within the larger chamber 26 which is laterally offset from the axis of the smaller chamber 24. When in its upper position (not shown) which is the flow-limiting position when flow is blocked through the passage 81, liquid admitted through the inlet 20 can pass through the passage 24A of the smaller chamber 24 under control of the needle valve 76 which regulates the flow-rate, and then flows through passages in the fixed guiding element 46 to the outlet 22. The valve member 30 is held in its upper flow-limiting position by the upper surface 50 of the mobile control element 42(similar to FIG. 4) under the bottom end of the lower stem 40 of the valve member 30. This is the normal position of the mobile control element 42 to which it is retracted and held by the return spring 54. As in the case of the first embodiment, a recess 66 is provided in the control element 42 into which the lower stem 40 of the valve member 30 enters when liquid pressure acts on the valve member 30 after the faucet, tap or the like, is turned on and the control element 42 is actuated by being pushed forward manually against the force of the return spring 54, which is the full-flow position of the components shown in FIG. 6. This is effective to locate the valve member 30 in the full-flow position. In the lower position of the valve member it has moved downward in the bore 74 in the pipe 10 sufficiently to unblock the transverse port 80 into the chamber 26 to obtain a larger flow-rate, even the maximum one, the screw 68 allowing adjustment of the vertical level of the full-flow position of the valve member 30 and thus the size of the unblocked portion of the port 80 to regulate this full-flow-rate.

In both the first and second embodiments, means are advantageously provided for adjusting the limited-flow rate, when the valve member 30 is in its flow-limiting position, in view of the type of application and/or the characteristics of the liquid-supply. This adjustment means includes, in a first construction (FIGS. 2, 3), a needle-valve 82 in an additional chamber 84 which allows adjustment of the limited-flow rate in the flow-limiting position of the valve member 30, in a second construction (FIG. 6) the needle valve 76 previously described in the longitudinal passage 24A of the smaller chamber 24 is incorporated to modify the size of the passage and thereby adjust the limited-flow rate.

Third Embodiment (FIGS. 7 to 10A)

Figure 8:
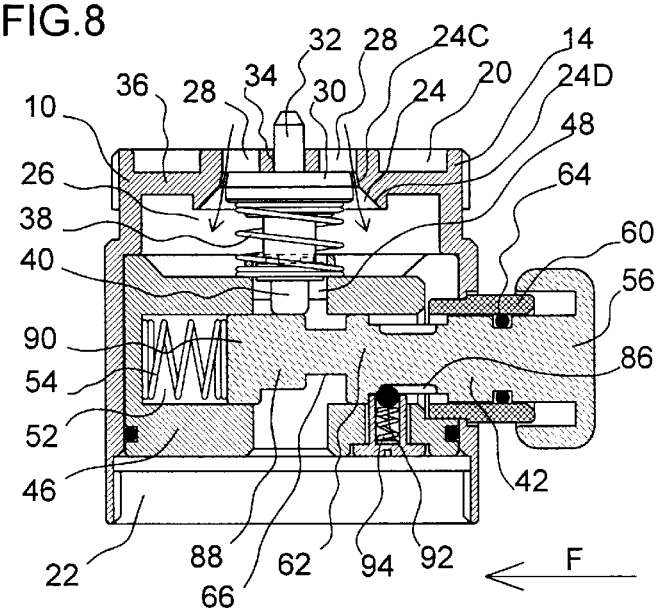
FIG. 8 is a sectional view of the device of FIG. 7 along the plane 8—8.

To improve the means for adjustment of the limited-flow rate when the valve member 30 is in the flow-limiting position, reference is made to FIGS. 7–10A. In this embodiment, as in the first embodiment (FIGS. 2, 3) liquid enters the flow limiter device through two symmetrical apertures 28 provided in the cross-piece 36 adjacent the liquid inlet 20 and flows through the first smaller chamber 24 which is arranged co-axial with the central axis of the pipe 10. In furtherance of the invention, the first chamber 24 has an upper cylindrical section 24C with a smaller diameter and a gradually enlarging conical or bell-mouthed section 24D which leads from the smaller diameter section 24C toward the second larger chamber 26. This smaller diameter section 24C of the chamber 24 receives a flow control member herein shown as a movable valve member 30, which is generally cylindrical in shape and has a diameter which fits within the smaller diameter section and allows relative movement therein. The diameter of the valve member 30 is preferably slightly smaller than the diameter of the section 24C of the chamber 24 providing a clearance space of a size which sets an initial lowest-value limited-flow rate of the device with the control element 42 and the valve member 30 in their initial stable positions. The valve member 30 has an upper stem 32 which is guided by an opening 34 provided in-between the apertures 28 in the cross-piece 36 integral with the pipe 10 (and thus similar to FIGS. 1–4) such that the valve member 30 is mounted for movement along an axis parallel to the longitudinal axis of the pipe 10. A compression restore spring 38 urges the valve member 30 upward toward the top of the chamber 24 to its initial stable position in which it is illustrated in FIG. 8.

The pipe 10 includes a fixed cylindrical guiding element 46 having one vertical facing hole 48 coaxial with the opening 34 to guide the lower stem 40 of the valve member 30, and a second horizontal facing cylindrical guide hole 52 coaxial with the tube 60 (similar to FIG. 4) in the central section of the pipe 10 to guide the mobile control element 42 for movement along its longitudinal axis upon actuation by the control button 56.

Figure 10:
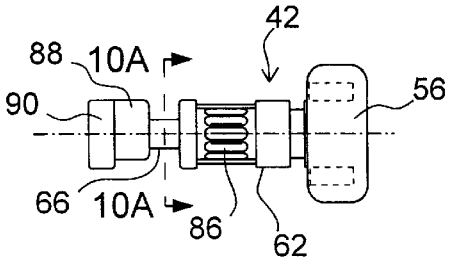
FIG. 10 is a detailed front view of a control element.
Figure 7:
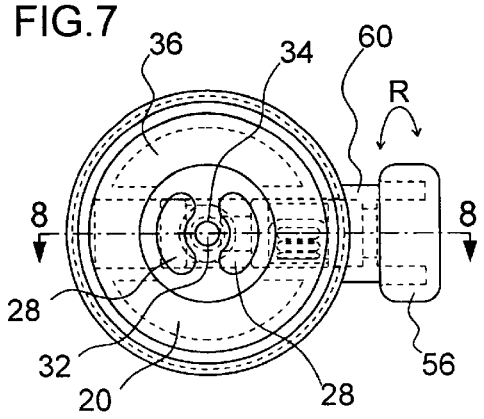
FIG. 7 is similar to FIG. 2 but shows a third embodiment.
Figure 10A:
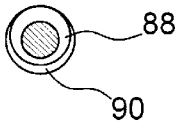
FIG. 10A is a sectional view of the element shown on FIG. 10 along the plane 10A—10A.

As shown in detail in FIG. 10, the mobile control element 42 and its control button 56 actuator are made as a unitary part, instead of as a multi-part assembly as is the case of the first embodiment, the term "control element" as used herein meaning either a multi-part or a single part assembly. As shown in FIG. 10 the control element 42 has a shank 62, the control button 56, and a groove having an O-ring 64 (FIGS. 8, 9) to ensure liquid tightness to the pipe 10. The shank 62 bears longitudinal stop grooves 86, in the present embodiment seven grooves in total, an eccentric cam 88, and a piston-like forward end 90 slideable in the cylindrical aperture 52 provided in the guiding element 46. This cylindrical guide hole 52 and the piston-like end 90 of the control element 42 which slides in the guide hole 52 ensure the support and guiding of the mobile control element 42 within the guiding element 46, the control element 42 also being moved against the force of a compression return spring 54 housed in the guide hole 52.

A ball 92, acted on by resilient means 94, is supported by the guiding element 46 to cooperate with any of the stop grooves 86 provided in the shank of the control element 42 and, by ball/groove cooperation, sets its rotational position and, through the rotary position of the cam 88, the flow limit in the flow-limiting position of the device.

FIG. 8 shows all above-described elements in a flow-limiting position where the flow limit is set at its lowest value. When the user opens the tap to which the flow limiter device is connected, the force due to liquid pressure on the valve member 30 moves it downward against the force of the restore spring 38 until its stem 40 abuts against the profile of the eccentric cam 88 which limits its movement and thus its level within the cylindrical section 24C or the conical section 24D of the smaller chamber 24. Since there is provided a gradually enlarging clearance space at the periphery of the valve member 30 upon movement of the valve member 30 into the conical section 24D of the chamber 26, this provides for adjustment of the limited-flow rate by varying the flow-limiting position of the valve member 30 within the conical section 24D by the cam 88 between the lowest-value position of FIG. 8 and the full-flow position of the valve member shown in FIG. 9 where it is adjacent the lower end of the conical section 24D. The liquid flow, shown by two arrows, is through the clearance space between the valve member 30 and the wall of the conical section 24D and the flow-rate is determined by the level of the valve member 30 set by the angular position of the cam 88.

According to the invention, the control element 42 is rotatable to adjust the vertical flow-limiting position of the valve member 30 which is determined by the location set for the bottom end of the stem 40 of the valve member 30 by the eccentric cam 88. This arrangement thus provides adjustment of the flow-limiting position of the valve member 30 in a second plane, herein shown as perpendicular to the longitudinal axis of the control element 30. Upon rotation by the user at any time of the control button 56 in any direction between positions determined by the ball/groove cooperation, the eccentric cam 88 is caused to rotate, the profile of which (FIG. 10A) raises or lowers the level of the valve member 30 resulting in an increase or decrease of the clearance space between said valve member 30 and the wall of the conical section 24D of the chamber 24, and thereby adjustment of the limited-flow rate. Simultaneously, the ball 92, by cooperating with any one of the stop grooves 86, keeps the control element 42 in a stable position—as long as it is not rotated by the user—and thus the liquid limited-flow rate at the value set by the user.

When the user wishes to obtain a larger liquid flow, the user pushes the control button 56 in its axial direction (arrow F, FIG. 8) against the return spring 54. The bottom of the stem 40 of the valve member 30 then leaves the profile of the eccentric cam 88, and drops or enters into a deep recess 66 in the shank 62 of the control element 42 and abuts against the bottom of the recess the radius of which is smaller than any radius of the eccentric cam 88, which allows a downward movement of the valve member 30, to the full-flow position shown in FIG. 9 and thus a larger liquid flow, even the maximum liquid flow-rate, can be obtained in this full-flow position of the device. In such configuration, the mobile control element 42 is locked against movement by the return spring 54 by the lower stem 40 of the valve member 30 which engages the lateral side of the eccentric cam 88. It will be noted that in this full-flow position, as in the flow-limiting position of the valve member 30 liquid flow is sequential through the smaller and larger chambers 24, 26.

If, in the full-flow position, the user shuts off or reduces the flow from the tap to which the flow limiter device is connected, the pressure of the liquid on the valve member 30 is reduced, its compression restore spring 38 drives it upwardly and the lower stem 40, by leaving the side of the eccentric cam 88, releases the control element 42 and allows the compression return spring 54 to return the control element 42 to its stable position shown in FIG. 8. The range of the downwards movement of the valve member 30 is, again, limited by the profile of the eccentric cam 88 which automatically ensures that the flow limiter device be returned to the position ensuring a limitation of the liquid flow. During above-described movements, the oblong profile of the stop grooves 86 has kept the ball 92 within one of said grooves and thus has maintained the limit set by the user.

An appropriate labeling of the control button can be easily achieved, for example, by having an arrow of which the thickness varies to indicate clearly and in a very understandable way in which direction the control button should be rotated.

Figure 11:
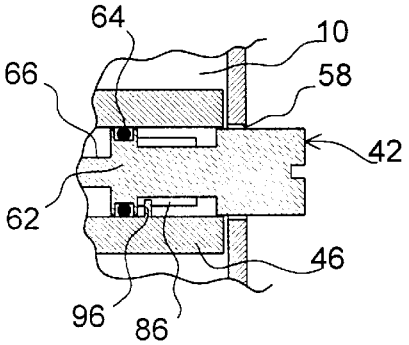
FIG. 11 is a fragmentary sectional view of an alternative construction for a control element.
Figure 9:
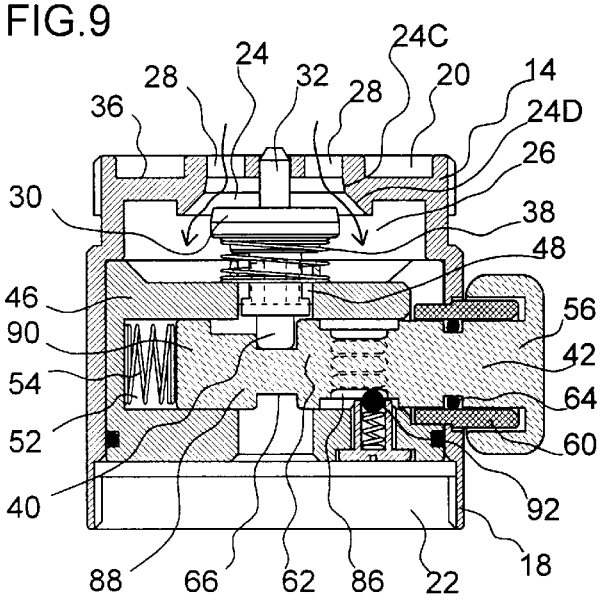
FIG. 9 is similar to FIG. 8, the flow limiter device set in a full-flow condition.

Embodiment of FIG. 11

To provide a flow limiter device control setting arrangement appropriate, for example, for hotels or other public facilities or establishments where it is desired to restrict, for security or other reasons, the convenience of setting a flow-rate or volume limit, reference is made to FIG. 11 which shows an alternative construction to the ball 92 and spring 94 (FIGS. 8–9) stop mechanism for resiliently holding the control element 42 in a specific limited-flow rate position. In keeping with the invention, a short fixed pin or shaft 96 is provided which enters any one of the stop grooves 86 in the shank 62 of the mobile control element 42. The shank 62 of the control element 42 is made with a diameter providing a close fit in the guide element 46 and the lateral aperture 58 in the wall of the pipe 10, and sealing members such as O-rings 64 may be provided (as shown) to prevent leakage at the aperture 58. In this case the tube 60 of the first embodiment is eliminated. The outer face of the mobile control element 42 is preferably provided with a small slot for receiving the end of a screwdriver. To adjust the flow-rate and set a new limit, the user simply pushes the control element 42 all the way to the left by the screwdriver, then rotates the screwdriver and thus the control element to position another stop groove 86 in alignment with the pin 96, and then allows the return spring 54 to return the control element to the position of FIG. 11 as the selected groove slides around the pin. The pin/ groove cooperation then prevents rotation of the control element and controls the flow-rate at the new specific limit set by the user.

As can be easily understood, any of the above-described embodiments of the flow limiter device of this invention can be easily incorporated in or added by any manufacturer to its range of taps as they just require mounting on the output nozzle on any tap, which are standardized with an internal thread, or they can be integrated directly in the output of such taps, valves, or faucets. Moreover, they can be added in-line to liquid delivery systems since they comprise, as disclosed herein, a pipe with a threaded inlet and a threaded outlet, and provide a valve member and control element actuable from outside the pipe, the valve member being located in a flow-limiting position in one state and being caused to move to another flow-limiting position or a full-flow position in a second state, in response to actuation of the control element manually or by local or remotely controlled power actuators.

FIG. 12

Figure 12:
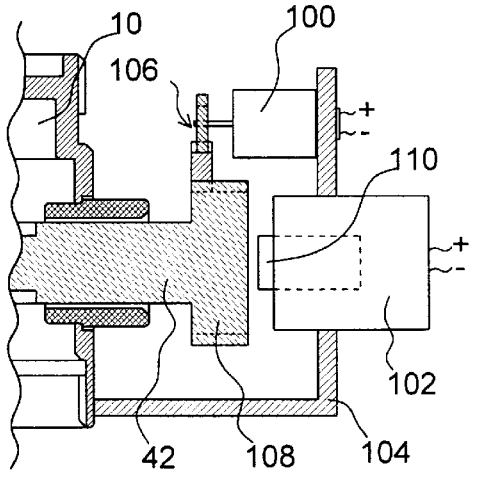
FIG. 12 is a fragmentary sectional view of a control unit for actuating a control element of a flow limiter device by power through local or remote control.
Figure 13:
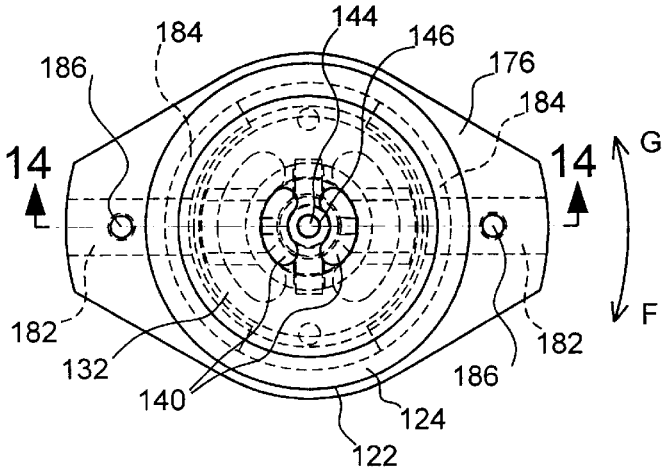
FIG. 13 is a simplified top view of a fourth embodiment of a flow limiter device incorporating a magnetic coupling between an external actuator and an internal flow-limiter valve according to the invention.
Figure 15:
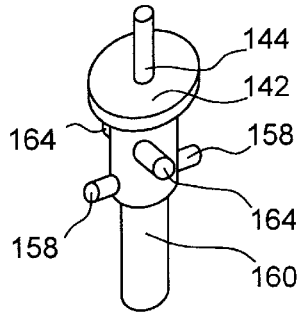
FIG. 15 is a perspective view of the flow limiter valve of FIG. 13.

Further in accordance with the invention, power actuators for flow limiter devices are shown in FIG. 12 to allow local or remote control of the power actuators. should the devices be mounted in a liquid delivery or distribution system in-line or at outlet nozzle locations. Axial and rotational movement of the control element 42 of a flow-limiter device is provided by a control unit shown herein as the combination of a micro-motor 100 and an electro-magnet 102 mounted on a bracket 104 on the outside of the pipe 10. The micro-motor 100 is connected to rotate the element 42 through a gear train 106 and teeth on the periphery of the control end 108 of the element 42 and the electro-magnet 102 is arranged to push the control element 42 by direct engagement of the electro-magnet actuator 110 with the outer face of the control end 108 against the opposing force of a return spring 54 (not shown in FIG. 12, shown, e.g. in FIG. 9). Assuming that the control element 42 is in an initial position wherein the valve member 30 is set in a specific limited-flow rate condition, to adjust and set a new limited-flow rate, upon controlled feed of electrical power from a source to actuate the electromagnet 102 it pushes the control element 42 all the way to the left, then the micro-motor 100 is actuated by controlled supply of electrical power from a source to rotate the control element 42 to a new angular position which may be indicated or displayed in response to a signal from an angular detection circuit incorporated in the control unit and operated by the motor 100 or the first gear of the illustrated gear train 106. Then the electromagnet 102 is disabled to allow the return spring 54 to return the control element 42 to the position of FIG. 12. By short circuiting the micro-motor 100 or by other methods of locking the motor 100 in a given rotational position, the motor and gear train 106 prevent uncontrolled rotation of the control element 42 which sets the limited-flow rate at the new specific rate corresponding to the angular position of the control element 42.

Fourth Embodiment (FIGS. 13 to 19A)

Further in accordance with the invention, in this embodiment, a magnetic-coupling is provided between a handle 176 outside the flow limiter device 120 and the control element 162 and valve member 142 inside the device, thereby eliminating a through-wall connection. The flow limiter device 120 is very similar to those previously described as it mainly comprises a cylindrical body 122 having on its upper part 124 an external thread 126 for being screwed to the internal thread of the nozzle of a faucet or tap. It has an internal thread 128 on its lower part 130 to receive a diffuser. The upper part 124 of the body 122 has also a liquid inlet 132 and the lower part 130 has a liquid outlet 134 while two cylindrical chambers 136, 138 having different diameters connect the inlet 132 to the outlet 134. Two apertures 140 connect the liquid inlet 132 to the first chamber 136 and a valve member 142 which has a diameter close to that of the chamber 136 is fixed to an upper stem 144 guided by the opening 146. The valve member 142 in its upper position (shown in FIG. 14A) limits the liquid flow (just as shown in FIG. 3 of the first embodiment) while in its lower position (shown in FIG. 14) it provides the full-flow position. The valve member 142 undergoes the action of resilient means, such as a coil spring 148, pushing it upward towards the chamber 136 and is guided by a central guiding element 150 fixed within the body 122. The central guiding element 150 has an inner part 152 which stands vertically and has a cylindrical shape (as in the previous embodiments) which provides (see FIG. 15A) inside the central opening 154 two lateral grooves 156 set vertically and diametrically opposed for guiding studs 158 on the lower stem 160 of the valve member 142 (see FIG. 15) so that the valve member 142 moves only vertically.

In carrying out the invention, a control element 162 (see FIG. 15B) is provided which is manually actuable and operatively connected to the valve member 142 inside the flow-limiter device 120. The control element 162 is mounted to rotate around the inner part 152 of the central guiding element 150. The lower stem 160 of the valve member 142 bears, at a level slightly above that of the studs 158, two diametrically opposed studs 164 (see FIG. 15) set 90° apart from the studs 158 and of a slightly larger diameter (for easy distinction during assembly). These studs 164, in the flow-limiting position (see FIG. 14A) of the flow control element 162 abut the upper edge 166 thereof, which provides an abutment which holds the valve member 142 in the raised flow-limiting position of the device 120. The flow control element 162 also has a discontinuity such as vertical (longitudinal) grooves 170 which allows the studs 164 to clear the abutment, when the flow control element 162 is rotated to the full-flow position (see FIG. 17), and determines the full-flow position of FIG. 14.

Figure 16:
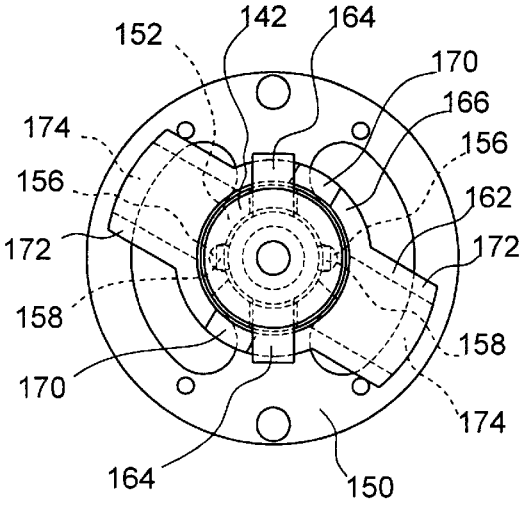
FIG. 16 is a top view of a partial assembly of the elements shown in FIGS. 15, 15A and 15B in a flow-limiting position.
Figure 17:
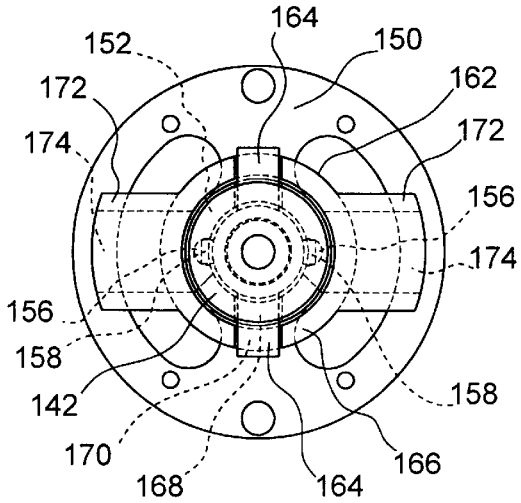
FIG. 17 is similar to FIG. 16, the elements being in a full-flow position.

Accordingly, in the flow-limiting position, the studs 164 abut the upper edge 166 of the control element 162 (see FIG. 16) and, in the full-flow position, the studs 164 are at the bottom of the grooves 170 which are of the same dimensions as the grooves 168 in the inner part of the guiding element 150 and, in this specific position, aligned with them (see FIG. 17).

The control element 162 is mounted to rotate around the inner part 152 of the central guiding element 150 limited by abutments to about 30° on each side (see FIGS. 18, 19) of a neutral axis (see FIGS. 17, 18A, and 19A) and has two lateral housings 172, diametrically opposed, which contain magnets 174.

Figure 14:
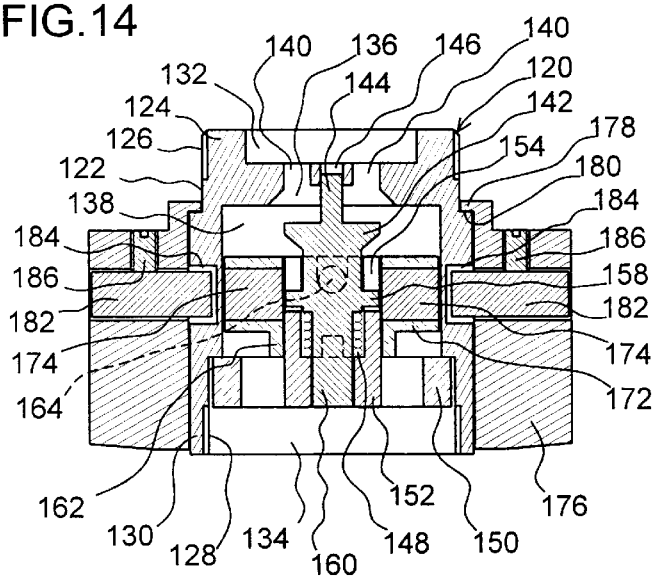
FIGS. 14 and 14A are cross-sectional views in the plane of lines 14—14 in FIG. 13, FIG. 14A showing the valve in flow limiting position.
Figure 15A:
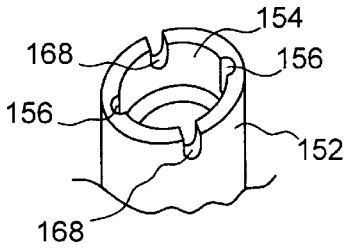
FIG. 15A is a partial perspective view of the fixed, inner guiding member for the valve.
Figure 14A:
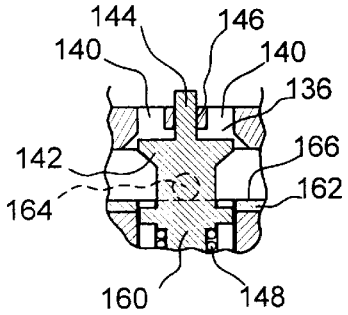
Figure 15B:
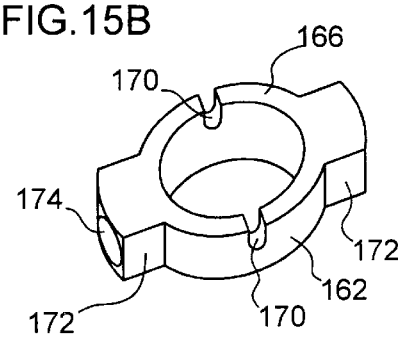
FIG. 15B is a perspective view of the annular control element for the valve.

As shown in FIG. 14, the handle 176 on the outside periphery of the device is manually rotatable, has an inwardly extending upper lip 178 which rests on an edge 180 of the body 122, and incorporates two magnets 182 projecting in diametrically opposed grooves 184 provided on the external periphery of the device 120 so that when the magnets 182 are set in place and locked in place as by screws 186, the handle 176 can rotate (FIG. 13 arrows F, G) around the body of the device 120. Preferably, the magnets 174 and 182 are arranged so that their facing ends have the same polarity and, as a result, all are undergoing repulsive forces. The grooves 184 are opposed and angularly limited to allow the handle 176 to rotate around the device 120 by about 45° in each direction (see FIGS. 18–19A) from the neutral axis, and thus the angle of rotation of the handle 176 is larger than that of the control element 162.

Figure 18:
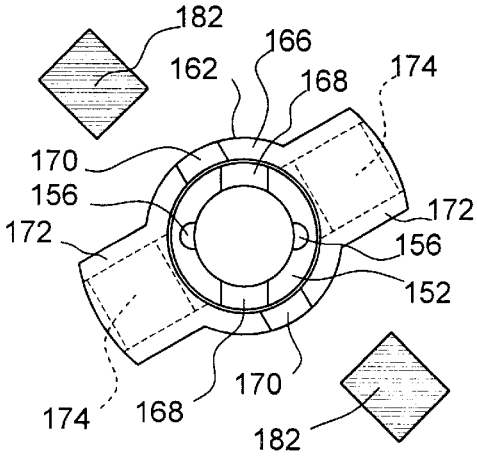
FIGS. 18, 18A, 19, and 19A show schematically the respective positions of some elements in flow-limiting and full-flow positions.
Figure 19:
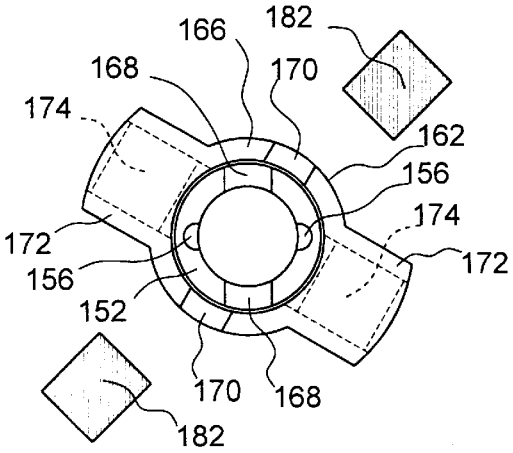

In the absence of liquid flow through the device 120, the spring 148 pushes the valve member 142 upwards; the studs 164 are above the edge 166 of the control element 162 and, as the magnets 174, 182 repel each other, the device 120 is in one of the positions shown on FIGS. 16, 18, or 19 where the grooves 168, 170 are not aligned. These two positions (FIGS. 18, 19) are stable positions as the handle 176 and the control element 162 are both at one of their end-of-movement positions. By operating the faucet or tap to which the device 120 is attached, liquid is admitted into the device 120 through the inlet 132, passes through the apertures 140, and the flow is limited by the space in-between the periphery of the chamber 136 and that of the valve member 142. The pressure on the valve member 142 moves it downwards against the spring 148 until the studs 164 of the valve member 142 abut the upper edge 166 of the control element 162 (FIG. 16) so that the movement of the valve is limited and the flow is limited to this preset limit.

Figure 18A:
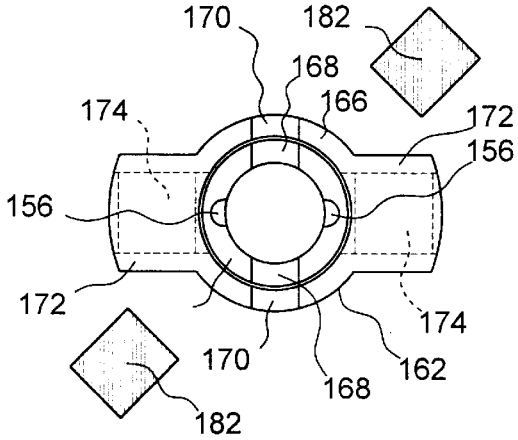

When the user wishes to obtain full-flow, the handle 176 is rotated either clockwise (if it is in the position of FIG. 19) or counter-clockwise (if it is in the position of FIG. 18). If it is in the position of FIG. 18, rotating the handle 176 counter-clockwise will rotate the magnets 182 counter-clockwise so the opposing torque will increase because the magnets 182 will be moved into position proximate the magnets 174. The magnets 174 do not move as the control element 162 is at one of its end-of-movement position and, just after the magnets 182 have moved beyond the magnets 174 because they rotate by 45° and the control element by 30°, due to repulsion the magnets 182 and thus the handle 176 will be automatically rotated towards their opposite end-of-movement position, while the magnets 174 will rotate the control element 162 in the opposite direction ( clockwise, almost half-way) until the grooves 170 and 168 are aligned (FIGS. 17, 18A). In this position, the valve member 142, under the pressure of the liquid, moves downwards against the spring 148 as the studs 164 slide downwards in the aligned grooves 168 and 170 while the studs 158 slide in the lateral grooves 156. Full-flow is available as the studs 164, engaged in the aligned grooves 168 and 170, lock the control element 162 against rotational movement.

If the flow is now reduced by partially or fully closing the faucet or tap, the device 120 being in the position shown in FIGS. 17 and 18A, the pressure on the valve member 142 is lowered and the spring 148 pushes the valve member 142 upwards. When the studs 164 exit from the aligned grooves 168, 170, the magnets 182 repulse the magnets 174 as the control element 162 is free to rotate clockwise while the handle 176 stays in its end-of-movement position. Rotation of the control element 162 results in the grooves 170 being no longer aligned with the grooves 168 while the studs 164 are above or abut on the upper edge 166. Thus, the device 120 is returned to its flow-limiting position. The control element 162 and the magnets 182, and the handle 176, are now in the position shown in FIG. 19, which again is a stable position as the magnets 174, 182 repel each other and thus keep the control element 162 and the handle 176 at their opposite end-of-movement positions.

Figure 19A:
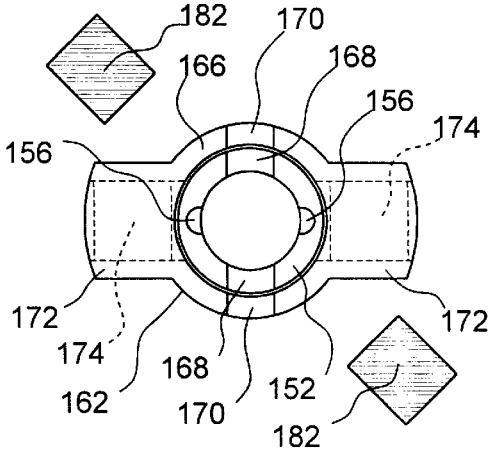

Should the user wish a larger flow, that is achieved by rotating the handle 176 and thus the magnets 182 clockwise and just after the magnets 182 have moved beyond the magnets 174, they will repel each other, as previously described, resulting in the control element 162 and the magnets 182 being then in the position shown on FIG. 19A where full-flow is provided as the grooves 168 and 170 are again aligned and engaged by the studs 164 of the valve member 142.

If, in this position (FIG. 19A), flow is reduced by operating the faucet or tap, the spring 148 will move the valve member 142 upwards, its studs 164 will exit from the grooves 168, 170 and, due to the repulsion of the magnets 174, 182, the control element 162 will rotate to reach the position shown on FIG. 18 where the elements attain the flow-limiting function.

In summary, full flow is obtained and the flow-limiting function is de-activated by rotating the handle 176 either clockwise or counter-clockwise, depending on its previous flow-limiting position.

Because of the presence of the magnets 174 in the control element 162, an alternative way (in place of the spring 148) of obtaining return force acting on the valve member 142 to push it upwards is to provide magnetically permeable material for the lower valve stem 160 which will result in an upwardly directed force to position the valve member 142 in the flow-limiting position.

As in the previously described embodiments of the invention (FIGS. 4, 5, 6), a screw (not shown) can be used at the bottom center of the control guiding element 150 to adjust the low position of the valve member 142, thus the full-flow limit position of the valve member 142.

Other modifications and changes can be made without departing from the invention, as set forth in the following claims.

I claim:

1. A flow limiter device for liquid delivery systems comprising:

a pipe having a liquid inlet and a liquid outlet, said pipe including a first chamber connected to the inlet, and a second chamber downstream of the first chamber and connected to the outlet, a valve member mounted in the pipe and movable between (1) a flow-limiting position, in which the valve member is located within the first chamber and limits liquid flow to a predetermined limited-flow rate while liquid flow is allowed into and through the first chamber, and (2) a full-flow position displaced downstream from the flow-limiting position in which the valve member is located within the second chamber and allows liquid flow at a greater full-flow rate through the first chamber and the second chamber to the outlet, a mobile control element in operative engagement with and holding the valve member in the flow-limiting position and which is actuable to move from operative engagement with the valve member and free the valve member, liquid acting on the valve member producing a liquid-pressure force which, when the valve member is free, moves the valve member from the flow-limiting position to the full-flow position.

2. A flow-limiter device according to claim 1 wherein the first and second chambers are substantially cylindrical and the first chamber is smaller in diameter than the second chamber.

3. A flow limiter device according to claim 2 wherein the valve member is substantially cylindrical and has a diameter which fits within the first chamber and allows relative movement of the valve member when located in the flow-limiting position, and which provides a substantial clearance space at its periphery relative to the second chamber when located in the full-flow position which allows flow through the first chamber and past the valve member through the clearance space at the full-flow rate.

4. A flow-limiter device according to claim 3 wherein a seal is provided between the valve member at its periphery and the first chamber which allows relative movement of the valve member when located in the first chamber in the flow-limiting position, and wherein the first chamber includes a passage through which liquid flows at the predetermined limited-flow rate past the valve member.

5. A flow-limiter device according to claim 4 wherein the passage is provided in the valve member.

6. A flow-limiter device according to claim 4 wherein a second passage is provided in the valve member which connects the first chamber to the second chamber and allows liquid flow at the full-flow rate through the first chamber when the valve member is located in the full-flow position.

7. A flow-limiter device according to claim 1 wherein a clearance space is provided between the valve member at its periphery and the first chamber which allows relative movement of the valve member while limiting flow to the predetermined limited-flow rate through the clearance space past the valve member, when the valve member is located in the flow-limiting position.

8. A flow-limiter device according to claim 2 wherein the first chamber includes a substantially cylindrical section with said smaller diameter and also includes a gradually enlarging conical section which leads from said smaller diameter section toward the second chamber, and wherein the valve member is substantially cylindrical and has a diameter which fits within the smaller diameter section and allows relative movement of the valve member, which provides a gradually enlarging clearance space at the periphery of the valve member upon its movement into the conical section of the first chamber, and adjustment of the limited-flow rate by varying the flow-limiting position of the valve member within the conical section.

9. A flow-limiter device according to claim 8 wherein the valve member when in the full-flow position is located adjacent the conical section and has a clearance space with respect to the second chamber which allows flow past the valve member through the first chamber and the second chamber at the full-flow rate.

10. A flow limiter device according to claim 1 wherein, when liquid flow into the inlet is reduced, the valve member is caused to shift from the full-flow position to the flow-limiting position by a restore force produced by a resilient member.

11. A flow limiter device according to claim 1 wherein said control element is actuable to move between flow-limiting and full-flow positions corresponding, respectively, to the flow-limiting and full-flow positions of the valve member.

12. A flow limiter device according to claim 1 including a return spring which returns the control element, and a part connected to the valve member which, when the valve member is in the full-flow position and liquid flows at the full-flow rate, holds the control element in the full-flow position against the return spring.

13. A flow limiter device according to claim 12 including a spring which exerts a force on the valve member to restore it to the flow-limiting position when liquid flow through the inlet into the pipe is reduced and the force exerted on the valve member due to liquid pressure is reduced, thereby releasing the part of the valve member from holding the control element and allowing the return spring to return the control element.

14. A flow limiter device according to claim 1 wherein the first and second chambers are coaxial with an axis of the pipe, the valve member is arranged on the pipe axis, the mobile control element is movably mounted on its axis which extends transverse to the pipe axis, and is actuable by force applied longitudinally to the mobile control element to move on its axis and shift the valve member, and wherein a resilient return member is provided to return the mobile control element after actuation.

15. A flow limiter device according to claim 1 wherein the control element has a flow-limiting position and positions a member which presents a surface operatively engaged by the valve member and setting the predetermined limited flow-rate.

16. A flow limiter device according to claim 15 wherein the member presents two surfaces operatively engaged by the valve member to set the limited flow-rate at two corresponding values, and wherein the control element has two corresponding flow-limiting positions.

17. A flow limiter device according to claim 15 wherein the member is adjustable to vary the location of the surface and thereby adjust the value of the flow-rate at the flow-limiting position of the valve member.

18. A flow limiter device according to claim 17 wherein the adjustable member is a rotatable eccentric cam which provides the surface operatively engaged by the valve member, the cam being rotatable by the control element to vary the location of its surface and thereby the flow rate.

19. A flow limiter device for liquid delivery systems comprising:

a liquid inlet and a liquid outlet, a chamber through which liquid flows downstream between the inlet and outlet, a valve member movably mounted in the chamber, the valve member having a flow-limiting position in the chamber where the valve member reduces liquid flow to a predetermined limited-flow rate through the chamber while the liquid flow is allowed, the valve member also having a full-flow position displaced downstream from the flow-limiting position, liquid pressure exerted on the valve member, when liquid is admitted through the inlet, providing a liquid-pressure force for moving the valve member from the flow-limiting position to the full-flow position, a control element which is operatively connected to hold the valve member in the flow-limiting position and which is actuable to free the valve member to move to the full-flow position under the liquid-pressure force, and a return member which returns the control element and allows the valve member to be restored to the flow-limiting position when the liquid flow through the chamber is reduced.

20. A flow limiter device according to claim 19 wherein liquid admitted through the inlet flows through the chamber in both the flow-limiting and full-flow positions of the valve member.

21. A flow limiter device according to claim 19 including a return member providing force which returns the control element.

22. A flow limiter device according to claim 19 including a resilient return member for the control element, both the resilient return member and the resilient restore member acting automatically to return the control element and to restore the valve member to stable positions when liquid flow through the inlet is reduced.

23. A flow limiter device according to claim 19 wherein the valve member and the control element move in respective planes that are perpendicular to each other.

24. A flow limiter device according to claim 19 wherein the chamber is substantially cylindrical, the valve member is mounted in the chamber for movement along the central axis of the chamber, the control element has a longitudinal axis perpendicular to said central axis along which it moves when actuated to shift an abutment carried by the control element between first and second positions, and wherein the valve member has a stem which rests on the abutment in the flow-limiting position of the valve member which determines its location relative to the chamber, and which clears the abutment in the full-flow position.

25. A flow limiter device according to claim 24 wherein the abutment is provided by a rotary cam carried by the control element which affords different abutment levels, the control element is actuatable both longitudinally and rotationally, and rotation of the cam via the control member varies abutment levels to vary the location of the valve member relative to the chamber and thereby permit adjustment of the flow-rate at the flow-limiting position.

26. A flow limiter device according to claim 19 wherein liquid flow past the valve member at the full-flow position varies depending on its location relative to the chamber, and wherein an adjustable member is provided which adjusts the location of the valve member at the full-flow position to adjust the full-flow rate at that position.

27. A flow limiter device according to claim 25 including a power actuator connected to rotate the control element.

28. A flow limiter device according to claim 25 including a power actuator connected to actuate the control element by moving it along its longitudinal axis.

29. A flow limiter device according to claim 25 wherein the control element has longitudinal grooves cooperating with a member to hold the control element stable after being longitudinally and rotatably actuated.

30. A flow limiter device according to claim 25 wherein rotationally spaced stops are provided for fixing the rotary cam in corresponding spaced rotary positions and set the abutment at corresponding levels, and thereby permit adjustment of the limited-flow rate by rotation of the control element between the rotary positions.

31. A flow limiter device according to claim 29 wherein the rotationally spaced stops are located on the control element to prevent rotation of the control element in a first stable position and allow rotation of the control element when the control element is moved longitudinally to a second adjustment position, and wherein a resilient member acts on the control element to return it from the second to the first stable position.

32. A flow limiter device according to claim 30 wherein the control element extends from outside to inside the flow limiter and is movable manually from outside the flow limiter.

33. A flow limiter device according to claim 30 wherein the control element extends from outside to inside the flow limiter and a power actuator is mounted on the outside of the flow limiter and connected to actuate the control element.

34. A flow limiter device for liquid delivery systems comprising:

a liquid inlet and a liquid outlet, a chamber through which liquid flows between the inlet and outlet, a valve member movably mounted in the chamber for movement to and from a flow-limiting position where the valve member limits flow past the valve member while flow is allowed at a predetermined limited-flow rate through the chamber, a control element which is operatively connected to the valve member, liquid pressure exerted on the valve member being effective to shift the valve member, when liquid flow is admitted through the inlet and the control element is actuated, from the flow-limiting position to the full-flow position wherein liquid flows past the valve member and flow is allowed at a full-flow rate through the chamber, the control element having a first position where it determines the flow-limiting position of the valve member and thereby sets the predetermined limited-flow rate, and a second position when actuated and where when moved by liquid pressure the valve member shifts to the full-flow position, a return member which returns the control element and allows the valve member to be restored to the flow-limiting position when the liquid flow through the chamber is reduced, wherein the control element is movably mounted inside the device and actuated by a handle movably mounted outside the device, and wherein a magnetic coupling is provided between the handle and the control element to actuate the control element and shift the valve member upon movement of the handle.

35. A flow limiter device for liquid delivery systems comprising:

a pipe having a liquid inlet and a liquid outlet, said pipe including a first chamber connected to receive liquid from the inlet when liquid is admitted into the pipe through the inlet, and a second chamber connected to receive liquid from the first chamber and to discharge the liquid through the outlet, a valve member mounted in the pipe for movement between (1) a flow-limiting position, in which the valve member is located within the first chamber and limits flow past the valve member while flow is allowed at a predetermined limited-flow rate through the first chamber, and (2) a full-flow position displaced from the flow-limiting position in which the valve member is located within the second chamber and allows flow at a greater full-flow rate through the first chamber and the second chamber to the outlet, a mobile control element in operative engagement with the valve member and which, when actuated from outside the device when liquid is admitted into the pipe through the inlet, causes the valve member to shift from one of the flow-limiting and full-flow positions to the other position, wherein the control element is mounted inside the device and an actuator is mounted outside the device, and wherein a magnetic coupling is provided between the actuator and the control element to actuate the control element and shift the valve member upon operation of the actuator.

36. A flow limiter device according to claim 35 wherein the device has a central guiding element inside the device which receives and guides movement of the valve member between the flow-limiting and full-flow positions, the control element is rotationally mounted inside the device on the central guiding element and has an abutment which is abutted by a stud connected to the valve member to determine the flow-limiting position of the valve member when the control element is rotated to the first position, and a discontinuity which allows the stud to clear the abutment and determines the full-flow position of the valve member when the control element is rotated to the second position, the actuator for the control element is a handle rotationally mounted outside the device, and the magnetic coupling is provided between the handle and the control element to rotate the control element and shift the valve member between its positions upon rotation of the handle.

37. A flow limiter device for liquid delivery systems comprising:

a liquid inlet and a liquid outlet, a chamber through which liquid flows between the inlet and outlet, a valve member movably mounted in the chamber for movement along a longitudinal axis inside the device between a flow-limiting position where the valve member limits flow past the valve member and a full-flow position, a control element mounted inside the device and operatively connected to the valve member, liquid pressure exerted on the valve member being effective to shift the valve member, when liquid flow is admitted through the inlet and the control element is actuated, from the flow-limiting position to the full-flow position, an abutment on the control element which has a first position established by rotation of the control element where the valve member operatively abuts the abutment which determines the flow-limiting position of the valve member and thereby sets a predetermined limited-flow rate, and a second position established by rotation of the control element where, when moved by liquid pressure, the valve member operatively clears the abutment and moves to the full-flow position, a handle movably mounted outside the device, and a magnetic coupling between the handle and the control element which connects the handle to rotate the control element and establish the first and second positions of the abutment and shift the valve member between its flow-limiting and full-flow positions.

38. A flow limiter device according to claim 37 wherein the control element is rotationally mounted inside and the handle is rotationally mounted outside the device.

39. A flow limiter device according to claim 37 wherein a central guiding element is mounted inside the device and the control element is mounted for rotation about the central guiding element.

40. A flow limiter device according to claim 39 wherein the control element forms a ring about the central guiding element and has an upper edge which provides the abutment, and a longitudinal groove which intersects the edge, and the valve member carries a stud which engages the abutment on the control element when the abutment is in the first position and clears the abutment and enters the groove when the abutment is in the second position.

41. A flow limiter device according to claim 38 wherein the handle includes a first magnet outside the device and the control element has a second magnet inside the device, the first and second magnets being mounted to provide forces causing the control element to move relatively to the valve member upon movement of the handle.

42. A flow limiter device according to claim 38 wherein the handle has a first magnet outside the device and the control element has a second magnet inside the device, the control element has limited rotational movement and the handle has greater rotational movement than the control element, and wherein the first and second magnets are mounted with like poles facing and provide repulsive forces causing the control element to move relatively to the valve member upon movement of the first magnet past the second magnet by the handle.

43. A flow limiter device for liquid delivery systems comprising:

a liquid inlet and a liquid outlet, a chamber through which liquid flows downstream between the inlet and outlet, a valve member movably mounted in the chamber, the valve member having a flow-limiting position in the chamber where the valve member limits flow to a predetermined limited-flow rate through the chamber while flow is allowed, the valve member also having a full-flow position displaced downstream from the flow-limiting position, liquid force exerted on the valve member, when liquid is admitted through the inlet, for moving the valve member from the flow-limiting position to the full-flow position, a control element which is operatively connected to hold the valve member in the flow-limiting position and which is actuable to free the valve member to move to the full-flow position, and a return member which actuates the control element and allows the valve member to be restored to the flow-limiting position when the liquid flow into the chamber is reduced.

* * * * *